US005727986A

United States Patent [19]

Stubenfoll et al.

[11] Patent Number: 5,727,986

[45] Date of Patent: Mar. 17, 1998

[54] RADIO-CONTROLLED TOY CAR WITH A ROLLING MECHANISM

[75] Inventors: Leonard Stubenfoll, Oak Brook, Ill.; Zenichi Ishimoto, Tokyo, Japan

[73] Assignee: Fertig Stubenfoll Design Group, Inc., Oak Brook, Ill.

[21] Appl. No.: 694,285

[22] Filed: Aug. 8, 1996

[30] Foreign Application Priority Data

Aug. 8, 1995 [JP] Japan ..... 7-202421

[51] Int. Cl.[6] ..... A63H 17/00; A63H 30/04

[52] U.S. Cl. ..... 446/437; 446/456

[58] Field of Search ..... 446/431, 437, 446/454, 456, 457, 441, 462, 230, 290

[56] References Cited

U.S. PATENT DOCUMENTS

| | | | |
|---|---|---|---|
| 2,182,642 | 12/1939 | Rexford | 446/437 X |
| 2,189,759 | 2/1940 | Lohr et al. | 446/290 |
| 4,300,308 | 11/1981 | Ikeda | 446/457 |
| 4,363,187 | 12/1982 | Shinohara | 446/437 |
| 4,676,763 | 6/1987 | Saito et al. | 446/230 |
| 4,705,487 | 11/1987 | Ishimoto | 446/456 X |
| 4,894,042 | 1/1990 | Kamikawa | 446/437 |
| 5,019,009 | 5/1991 | Chao-Chin et al. | 446/437 |
| 5,334,075 | 8/1994 | Kakizaki et al. | 446/456 X |

FOREIGN PATENT DOCUMENTS

| | | |
|---|---|---|
| 0 187 895 | 7/1986 | European Pat. Off. . |
| 533 428 | 2/1941 | United Kingdom . |

*Primary Examiner*—D. Neal Muir
*Attorney, Agent, or Firm*—Young & Thompson

[57] ABSTRACT

A rolling mechanism for a radio-controlled toy car causes a rolling motion of the radio-controlled toy car around a longitudinal direction along which the radio-controlled toy car travels. The rolling mechanism includes a rotation arm, which extends to have a component orthogonal to the longitudinal direction. The rotation arm has a free end and a pivotally fixed end, around which the rotation arm rotates, so that the free end defines a circle in a plane perpendicular to the longitudinal direction, where the circle completely encompasses the radio-controlled toy car in view of the perpendicular plane. A rotation mechanism is provided to be mechanically connected to the pivotally fixed end for forcibly rotating the rotation arm around the pivotally fixed end so as to roll the radio-controlled toy car around the longitudinal direction.

20 Claims, 8 Drawing Sheets

RADIO-CONTROLLED TOY CAR WITH A ROLLING MECHANISM

BACKGROUND OF THE INVENTION

The present invention relates to a radio-controlled toy car, and more particularly to a rolling mechanism for causing a radio-controlled toy car to roll around a longitudinal center axis extending along a traveling direction of the toy car.

In recent years, the radio-controlled toy car has become complicated in accordance with the tendency to pursue various and complex motions in order to attract a great deal of attention. This tendency is to cause surprise motions such as rapid turning motions and up and down motions during the normal travel of the radio-controlled toy car so as to provide unique and attractive emotions.

The inventors have achieved quite novel and unique surprising motions that are rapidly and unexpectedly caused during the normal travel of the radio-controlled toy car that attract a great deal of attention without, however, raising problems that increase the manufacturing cost and make the toy difficult for children to operate.

SUMMARY OF THE INVENTION

Accordingly, it is a primary object of the present invention to provide a radio-controlled toy car capable of showing surprising and attractive motions rapidly and unexpectedly during the normal travel of the radio-controlled toy car that attract a great deal of attention.

It is a further object of the present invention to provide a radio-controlled toy car with a simple structure for avoiding unnecessary increases in the manufacturing cost.

It is a further object of the present invention to provide a radio-controlled toy car which is easily operable by children.

It is another object of the present invention to provide a rolling mechanism for causing a surprising and attractive rolling motion rapidly and unexpectedly during the normal travel of the radio-controlled toy car that attract a great deal of attention.

It is still another object of the present invention to provide a rolling mechanism for causing a surprising and attractive rolling motion for a radio-controlled toy car with a simple structure for avoiding unnecessary increases in the manufacturing cost.

It is yet another object of the present invention to provide a rolling mechanism for causing a surprising and attractive rolling motion for a radio-controlled toy car which is easily operable by children.

The above and other objects, features and advantages of the present invention will be apparent from the following descriptions.

The present invention provides a rolling mechanism for a radio-controlled toy car that causes a rolling motion of the radio-controlled toy car around a longitudinal direction along which the radio-controlled toy car travels. The rolling mechanism includes a rotation arm, which extends to have a component orthogonal to the longitudinal direction. The rotation arm has as free end and a pivotally fixed end, around which the rotation arm rotates, so that the free end defines a circle in a plane perpendicular to the longitudinal direction, where the circle completely encompasses the outermost periphery of the radio-controlled toy car projected onto the perpendicular plane. A rotation mechanism is mechanically connected to the pivotally fixed end for forcibly rotating the rotation arm around the pivotally fixed end so as to roll the radio-controlled toy car around the longitudinal direction.

The present invention may include body over a chassis, a driving motor on the chassis for generating a driving power and for being radio-controlled, a transmission system on the chassis for transmitting a driving power of the driving motor to the tires, and a rolling mechanism on the chassis for causing a rolling motion of the radio-controlled toy car around a longitudinal direction along which the radio-controlled toy car travels. The rolling mechanism includes a rotation arm, which extends to have component orthogonal to the longitudinal direction. The rotation arm has a free end and a pivotally fixed end, around which the rotation arm rotates, so that the free end defines a circle in a plane perpendicular to the longitudinal direction, where the circle completely encompasses the radio-controlled toy car in the perpendicular plane. A rotating mechanism is also provided that is mechanically connected to the pivotally fixed end for forcibly rotating the rotation arm around the pivotally fixed end so as to cause the rolling motion of the radio-controlled toy car around the longitudinal direction.

BRIEF DESCRIPTION OF THE DRAWINGS

Preferred embodiments of the present invention will be described in detail with reference to the accompanying drawings.

DISCLOSURE OF THE INVENTION

Figure 1:
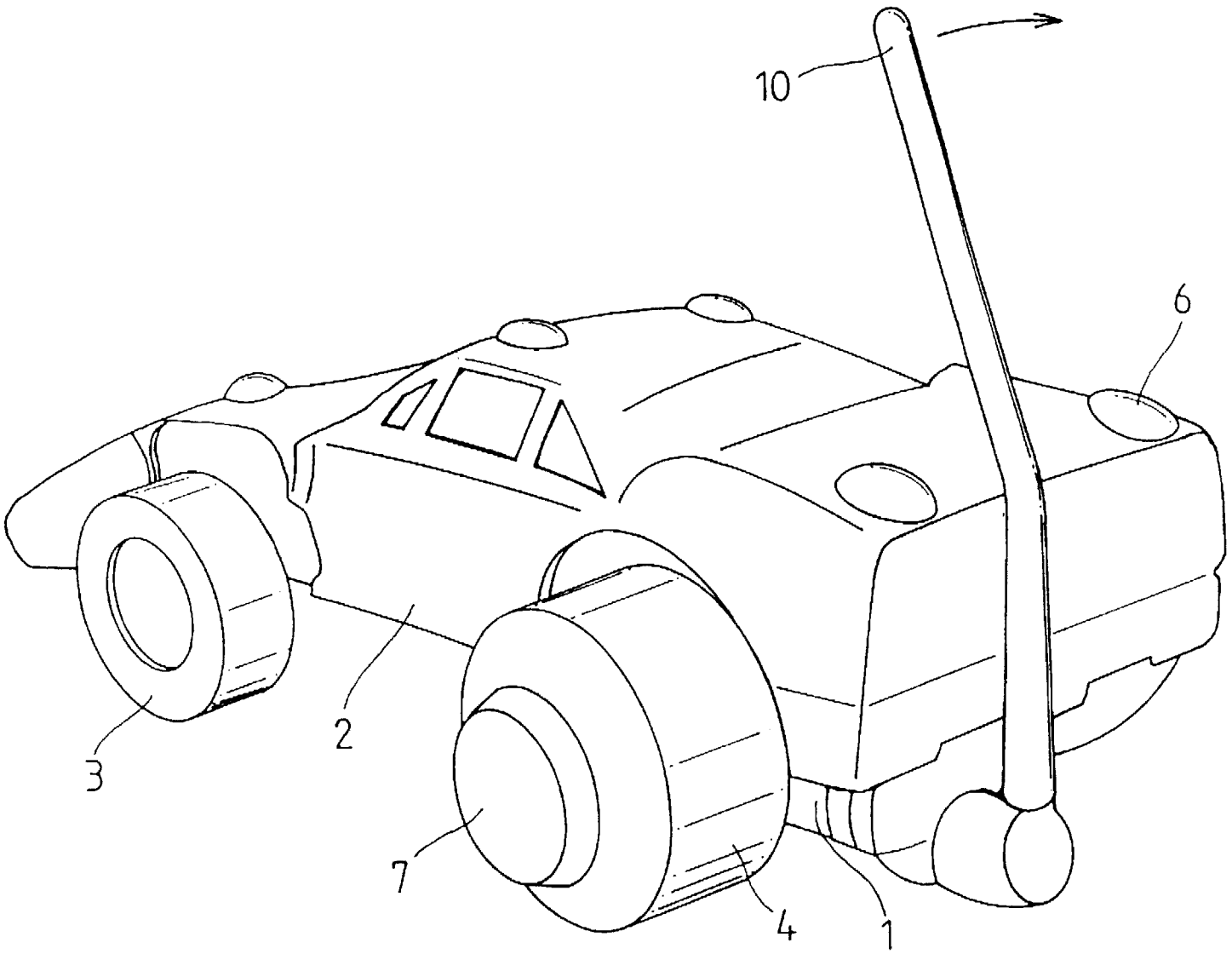
FIG. 1 is a schematic view illustrative of a radio-controlled toy car provided with a rolling mechanism having a rotation arm extending from a rear portion for rendering the radio-controlled toy car roll around a longitudinal axis thereof in accordance with the present invention.

The present invention provides a radio-controlled toy car and a rolling mechanism for a radio-controlled toy car that causes a rolling motion of the radio-controlled toy car around a longitudinal direction along which the radio-controlled toy car travels. The rolling mechanism includes a rotation arm, which extends to have a component orthogonal to the longitudinal direction. The rotation arm has a free end and a pivotally fixed end, around which the rotation arm rotates, so that the free end defines a circle in a plane perpendicular to the longitudinal direction, where the circle completely encompasses the outermost periphery of the radio-controlled toy car projection onto the perpendicular plane. A rotation mechanism is mechanically connected to the pivotally fixed end for forcibly rotating the rotation arm around the pivotally fixed end so as to cause the rolling motion of the radio-controlled toy car around the longitudinal direction.

The rotating mechanism may optionally include a driving force transmission mechanism which is mechanically connected to a driving power transmission system transmitting a driving power to tires of the radio-controlled toy car t to propet the radio controlled toy car. The driving force transmission mechanism is capable of transmitting a part of the driving power into the pivotally fixed end of the rotation arm while the driving power is transmitted to the tires so as to forcibly rotate the rotation arm around the pivotally fixed end while the radio-controlled toy car is moving.

The driving force transmission mechanism may advantageously include a shaft mechanically connected to the pivotally fixed end of the rotation arm, a flat gear on the shaft that is movable along the shaft, a worm gear mechanically connected to the driving power transmission system, a spring member that applies a spring force to the shaft in a first direction along the flat gear, and a movable rod, which has a pivotally fixed end and a free end being positioned in contact with the flat gear at an opposite side to the side at which the spring member is provided. The movable rod rotates around the pivotally fixed end to have the free end move along the shaft. A shifter is provided for shifting the movable rod so as to have the moveable rod rotate around the pivotally fixed end. The shifter moves the free end in a second direction along the shaft against the spring force until the flat gear becomes engaged with the worm gear so that the driving power of the driving motor is transmitted via the worm gear and the flat gear to the shaft, whereby the shaft and the rotation arm rotate.

The shifter may optionally comprise a solenoid electromagnet and an inner space, and a permanent magnet that is movable in a horizontal direction parallel to the shaft. The movable permanent magnet is connected via a link rod to the movable rod at its position between the pivotally fixed end and the free end in contact with the flat gear. The movable permanent magnet moves into the inner space of the solenoid electromagnet by an attraction force of the solenoid electromagnet when a current is applied, whilst the movable permanent magnet moves out of the inner space in response to the spring force of the spring member transmitted via the flat gear and the movable rod.

Alternatively, the shifter may also comprise an auxiliary motor generating a rotation force, an auxiliary transmission gear mechanism engaged with the auxiliary motor, and a crank gear engaged with the transmission gear mechanism for receiving the rotation force transmitted from the auxiliary motor via the auxiliary transmission gear mechanism. The crank gear is mechanically connected at its eccentric position with a supporting rod connected to the movable rod at its position between the pivotally fixed end and the free end in contact with the flat gear to thereby have the supporting rod move reciprocally by rotation of the crank gear.

A disk-like member may be fixed to the shaft at an opposite end to the end connected to the rotation arm, and an additional spring member may be connected to the disk-like member at its eccentric position for applying an additional spring force to the disk-like member so that the eccentric position of the disk-like member is forced to its highest level whereby the rotation arm remains extended upwardly.

Alternatively, the rotating mechanism may include an additional motor for generating a rotation force. The additional motor is radio-controlled independently from a driving motor generating a driving power by which the radio-controlled toy car travels. A rotation force transmission mechanism is mechanically connected to the additional motor for transmitting the rotation force of the additional motor to the pivotally fixed end of the rotation arm to forcibly rotate the rotation arm around the pivotally fixed end independently of the motion of the radio-controlled toy car.

It is also preferable that the rotation arm is made of a material selected from the group consisting of polycarbonate and nylon to obtain a large resistance to friction and a small friction coefficient.

It is also preferable that the rotation arm is made of a material which has a large resistance to friction and a small friction coefficient.

It is also preferable that the rotation arm includes piano wires to increase its strength.

It is also preferable that the body of the radio-controlled toy car is provided with a plurality of convex portions which are made of a material having a large resistance to friction but a small friction coefficient to protect the body from damage due to the strong friction encountered when the radio-controlled toy car turns upside down.

It is also preferable that the convex portions are made of a material selected from the group consisting of metals, polycarbonate and nylon.

It is also preferable that the tires are provided on these outside surfaces with guard rings made of a material having a large resistance to friction but a small friction coefficient so that the guard rings extend outwardly to protect the tires from damage due to the strong friction when the radio-controlled toy car turns over and lies on its side.

It is also preferable that the guard rings are made of a material selected from the group consisting of metals, polycarbonate and nylon.

PREFERRED EMBODIMENTS

A first embodiment according to the present invention will be described in detail with reference to the drawings. A radio-controlled toy car has a rolling mechanism having a rotation arm that extends in a vertical direction perpendicular to a horizontal and longitudinal center axis of the radio-controlled toy car and that rotates in a plane perpendicular to the horizontal and longitudinal center axis where the rotation arm has such a length that a free end of the rotation arm is always positioned outside the body of the radio-controlled toy car in view of the perpendicular plane.

With reference now to FIG. 1, a radio-controlled toy car has a chassis 1 and a body 2 which is provided over the chassis 1 and front and rear tires 3 and 4. On the rear tires, guard rings 7 are extended outwardly. The body has a plurality of convex portions 6. At the rear end of the chassis 1, a rotation arm 10 is provided, which extends in a direction orthogonal to a longitudinal direction along which the radio-controlled toy car travels. The rotation arm 10 has a free end and a pivotally fixed end, around which the rotation arm rotates so that the above free end defines a circle in a plane perpendicular to the above-mentioned longitudinal direction, wherein this circle completely encompasses the radio-controlled toy car including the tires 3 and 4. The rolling mechanism of the radio-controlled toy car comprises the rotation arm 10 and a rotation force transmission mechanism not illustrated in FIG. 1 for forcibly rotating the rotation arm 10 around the pivotally fixed end so as to roll the radio-controlled toy car around the longitudinal direction.

In this embodiment, as described below in detail, the rotation force transmission mechanism is mechanically connected to a transmission system for transmitting a part of the driving power for propelling the radio-controlled toy car into the pivotally fixed end of the above rotation arm 10 while the driving power is transmitted to the rear tires 4 so as to forcibly rotate the rotation arm 10 around the pivotally fixed end while the radio-controlled toy car is moving. This means that the radio-controlled toy car rapidly turns over and lies on its side or turns upside down even during the travel of the radio-controlled toy car, for which reason the body 2 is required to have a certain resistivity to friction from contact with the road or ground. It is preferable that the body 2 is made of a material having a possible large resistance to friction but a possible small friction coefficient.

In this embodiment, the body 2 is provided with a plurality of the convex portions 6 which are made of a material having a large resistance to friction but a small friction coefficient, such as metals, for example, iron or polycarbonate or nylon. The guard rings 7 are provided on the outside surfaces of the rear tires 4 so that the guard rings 7 extend outwardly to protect the tires 3 and 4 made of rubber from damage due to friction when the radio-controlled toy car turns over and lies on its side. The guard rings 7 may be made of the same material as the convex portions 6 such as metals, polycarbonate or nylon. Needless to say, it is preferable that the guard rings 7 are provided not only on the rear tires 4 but also on the front tires 3.

If the rotation arm 10 rotates to force the radio-controlled toy car to actively roll around the longitudinal direction along which the radio-controlled toy car travels, then the free end of the rotation arm 10 violently hits the road or ground whereby the free end of the rotation arm 10 is forced to receive a remarkably violent friction and receive instantaneously a remarkably large force in an opposite direction to the rotation direction along which the rotation arm 10 rotates. For which reasons, the rotation arm 10 is required to be made of a material which have a large resistance to friction and a small friction coefficient as well as a large strength. It is therefore preferable that the rotation arm 10 is made of polycarbonate or nylon and further includes piano wires to increase in strength thereof.

Figure 2:
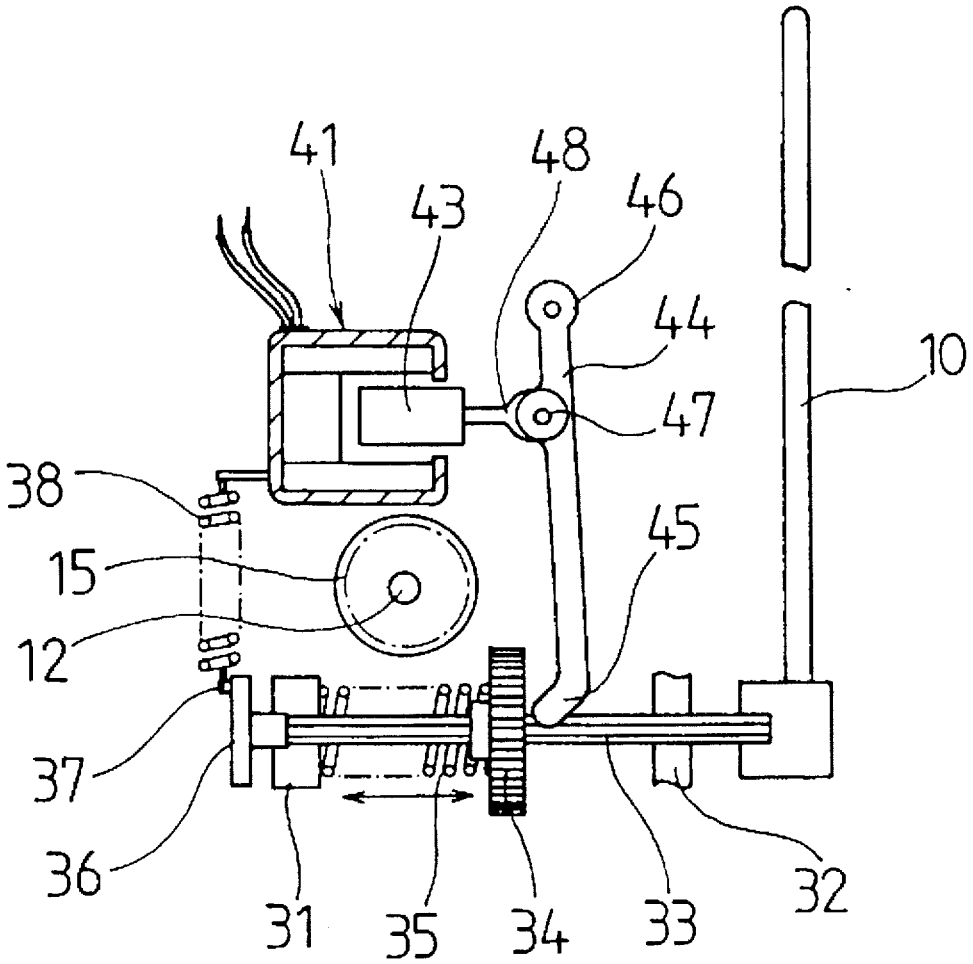
FIG. 2 is a view illustrative of a rolling mechanism having a rotation arm for rendering the radio-controlled toy car roll around a longitudinal axis thereof in accordance with the present invention.
Figure 3:
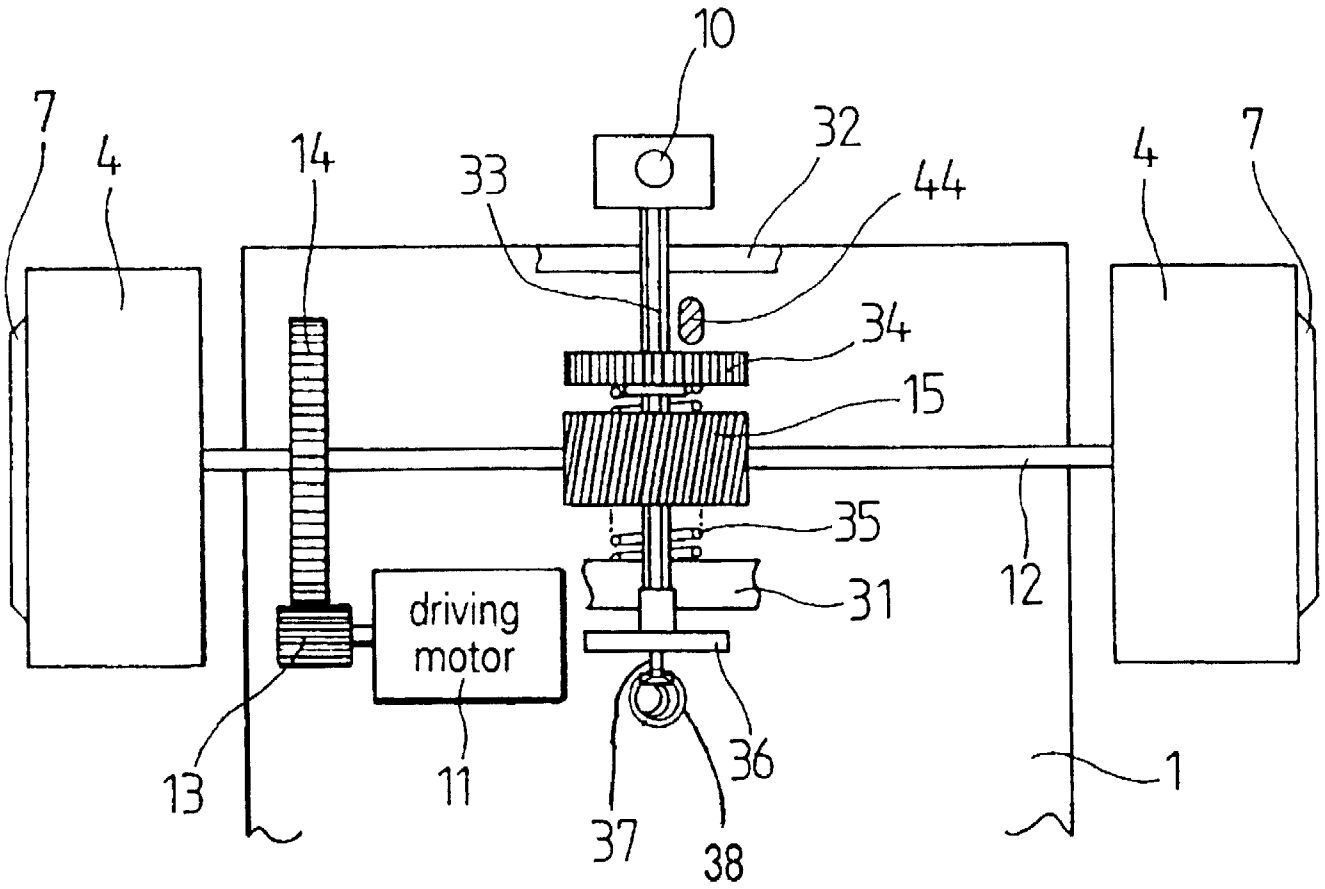
FIG. 3 is a view illustrative of a driving force transmission mechanism for transmitting a driving force of a motor not only to rear tires but also to a rolling mechanism having a rotation arm for rolling the radio-controlled toy car around a longitudinal axis thereof in accordance with the present invention.

With reference now to FIGS. 2 and 3, a driving motor 11 is provided for generating a driving power by which the rear tires 4 rotate to propel the radio-controlled toy car. The driving motor 11 has a rotary shaft which is connected to a gear 13. The gear 13 is engaged with a flat gear 14 having a diameter much larger than a diameter of the gear 13. The flat gear 14 is connected at its center to a rotary shaft 12 connected to the rear tires 4. The flat gear 14 is provided at a left side of the longitudinal axis of the chassis 1 in FIG. 3. At the center portion of the rotary shaft 12, a worm gear 15 is provided. An additional gear may be provided between the gear 13 and the flat gear 14 to adjust the gear ratio between them. When the driving motor 11 is driven, the rotation power is transmitted through the gear 13 and the flat gear 14 to the rotary shaft 12 whereby the rear tires 4 rotate.

Another flat gear 34 is further provided on the chassis 1. The flat gear 34 is fixed at its center to a hexagonal shaft 33 extending in a longitudinal direction perpendicular to the rotary shaft 12 connecting the rear tires 4. The hexagonal shaft 33 is supported by first and second bearings 31 and 32 which are provided at opposite ends thereof. The flat gear 34 is movable along the hexagonal shaft 33. A spiral spring member 35 generating an extension force is provided between the first bearing 31 and the flat gear 34 so that the flat gear 34 is normally forced toward the second bearing 32.

The hexagonal shaft 33 is projected from the rear end portion of the chassis 1. A rear end of the hexagonal shaft 33 is fixed with the pivotally fixed end of the rotation arm 10 that extends in a direction perpendicular to the longitudinal direction along which the radio-controlled toy car travels, wherein the free end of the rotation arm 10 is positioned above the top of the body 2 of the radio-controlled toy car. A front end of the hexagonal shaft 33 is provided with a disk-like member 36 which is further provided at its eccentric portion with a projection 37. A solenoid electromagnet 41 is securely fixed over the chassis 1. Another spiral spring member 38 has a first end connected to the projection 37 of the disk-like member 36 and a second end connected to the solenoid electromagnet 41 so that the projection 37 of the disk-like member 36 is forced upwardly, whereby the projection 37 is forced to be positioned at an upper portion of the disk-like member 36. If the projection 37 is positioned at an upper portion of the disk-like member 36, then the rotation arm 10 is positioned to extend upwardly. This means that if no force other than the spring force of the spiral spring member 38 is applied to the hexagonal shaft 33, then the rotation arm 10 is positioned to extend upwardly.

In the solenoid electromagnet 31, a movable permanent magnet core 43 is movable in a direction parallel to the hexagonal shaft 33. The movable permanent magnet core 43 moves by an attractive force toward a fixed magnet core of the solenoid electromagnet 41. The movable permanent magnet core 43 is provided with a supporting shaft 48 extending in a longitudinal direction. An end portion 47 of the supporting shaft 48 is pivotally fixed to a rod 44 which has a top end 46 and a bottom end which is in contact with the flat gear 34 but at an opposite side to the side at which the spiral spring member 35 is provided. The rod 44 is allowed to rotate at a small angle around the top end 46 of the rod 44. If the movable permanent magnet core 43 moves out from an inner space of the solenoid electromagnet 41, then the bottom end of the rod 44 moves away from the flat gear 34. If, however, the movable permanent magnet core 43 moves into the inner space of the solenoid electromagnet 41, then the bottom end of the rod 44 moves toward the flat gear 34 to push the same against the extension force of the spiral spring member 35.

If a current is supplied to the solenoid electromagnet 41 to magnetize the fixed magnetic core, then the movable permanent magnet core 43 is attracted to the fixed magnetic core of the solenoid electromagnet 41. As a result, the bottom end of the rod 44 moves toward the flat gear 34 to push the same against the extension force of the spiral spring member 35 until the flat gear 34 moves into a position under the worm gear 15 so that the flat gear 34 is engaged with the worm gear 15 whereby the rotation of the worm gear 15 is transmitted through the flat gear 34 to the hexagonal shaft 33. As a result, when the current is applied to the solenoid electromagnet 41, the driving power of the driving motor 11 is transmitted to the hexagonal shaft 33 whereby the rotation arm 10 rotates to have the radio-controlled toy car roll around the longitudinal direction in which the radio-controlled toy car travels. When the current is removed from the solenoid electromagnet 41 the movable permanent magnet core 43 moves out from the internal space of the fixed magnetic core in the solenoid electromagnet 41. As a result, the bottom end of the rod 44 moves away from the flat gear 34 so that the flat gear 34 moves out from the position under the worm gear 15 and is disengaged from the worm gear 15, whereby the transmission of the rotation of the worm gear 15 through the flat gear 34 to the hexagonal shaft 33 is discontinued. As a result, it no current is applied to the solenoid electromagnet 41, then the driving power of the driving motor 11 is not transmitted to the hexagonal shaft 33 whereby the rotation arm 10 remains positioned to extend upwardly and the radio-controlled toy car travels normally.

Figure 4:
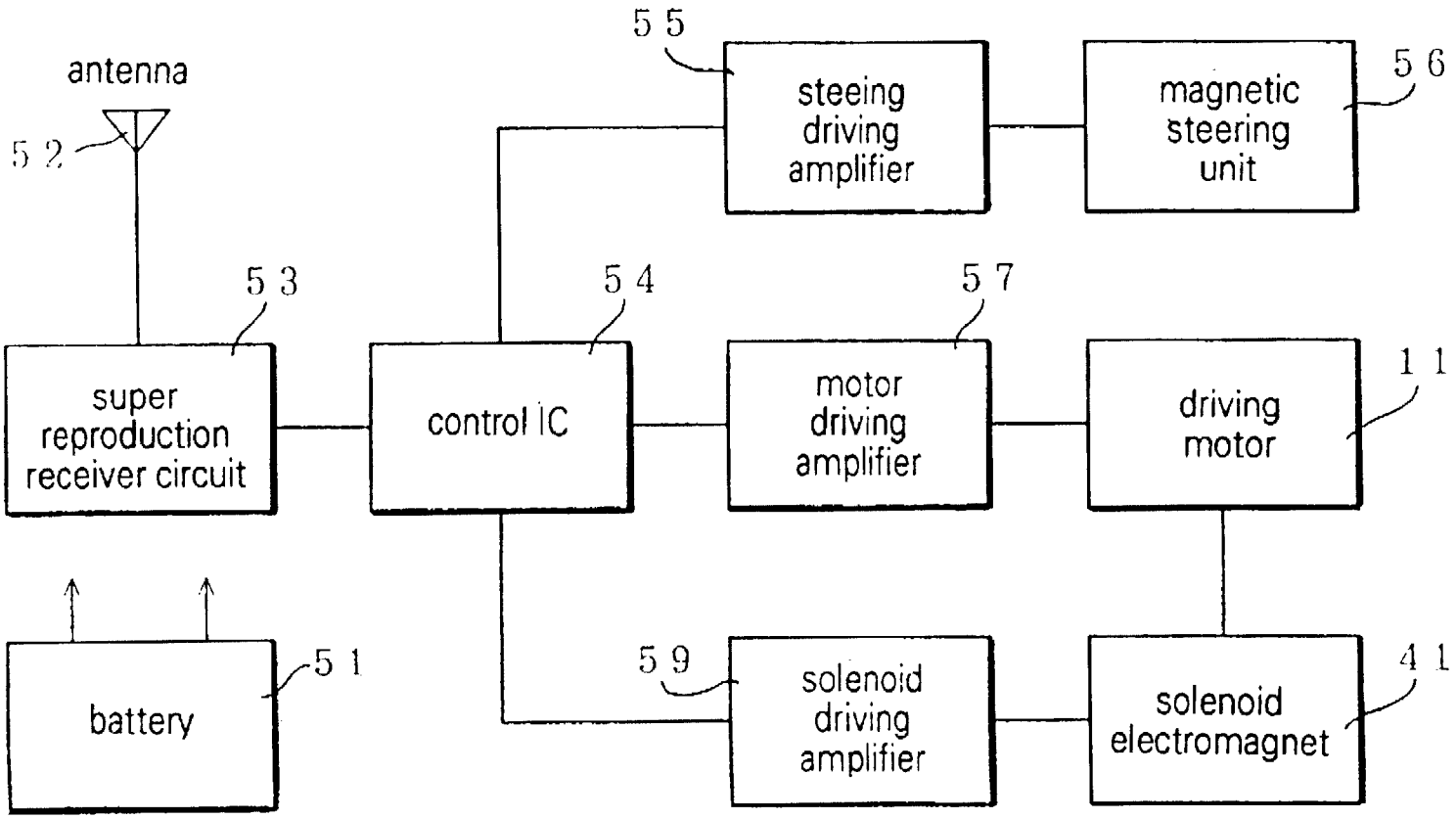
FIG. 4 is a block diagram of a control unit of a radio-controlled toy car provided with a rolling mechanism in accordance with the present invention.

With reference to FIG. 4, the control unit is provided on the chassis 1. The control unit is supplied with power from a battery 51 and includes a super reproduction receiver circuit 53 electrically connected to an antenna 52 that receives control signals transmitted from a radio transmitter. A control IC 54 is electrically connected to the super reproduction receiver circuit 53 for receiving the control signals and supplying a steering control signal, a driving motor control signal and a solenoid electromagnet control signal. A steering driving amplifier 55 is electrically connected to the control IC 54 for receiving the steering control signal and amplifying the steering control signal. A magnetic steering unit 56 is electrically connected to the steering driving amplifier 55 for receiving the amplified steering control signal from the steering driving amplifier 55 so that the magnetic steering unit 56 operates in accordance with the steering control signal. A motor driving amplifier 57 is electrically connected to the control IC 54 for receiving the driving motor control signal from the control IC 54 and amplifying the same. The driving motor 11 is electrically connected to the motor driving amplifier 57 for receiving the driving motor control signal and operating in accordance with the driving motor control signal. A solenoid driving amplifier 59 is electrically connected to the control IC 54 for receiving the solenoid electromagnet control signal from the control IC 54 and amplifying the same. The solenoid electromagnet 41 is electrically connected to the solenoid driving amplifier 59 for receiving the amplified solenoid electromagnet control signal and operating so that the movable permanent magnet core 43 moves out from or into the inner space of the fixed magnetic core of the solenoid electromagnet 41.

The operation of the roll mechanism described above will be described with reference to FIGS. 5A through 5F.

Figure 5A:
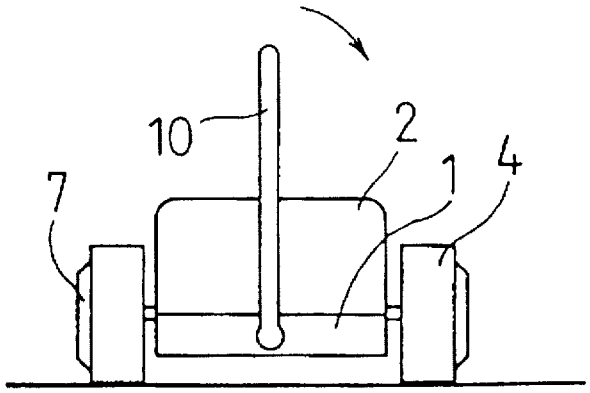
FIGS. 5A through 5F are sequential rear views illustrative of a radio-controlled toy car during the rolling motion caused by a rotation of a rotation arm of a rolling mechanism.
Figure 5B:
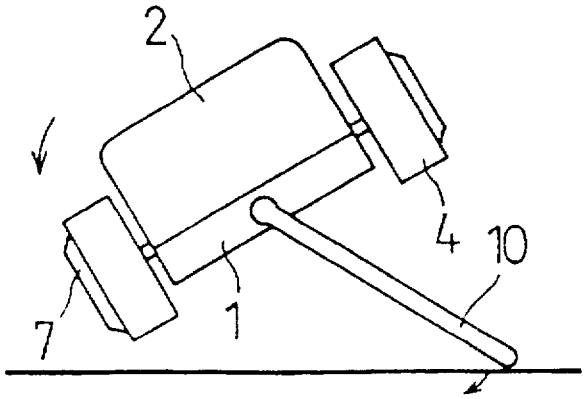
Figure 5C:
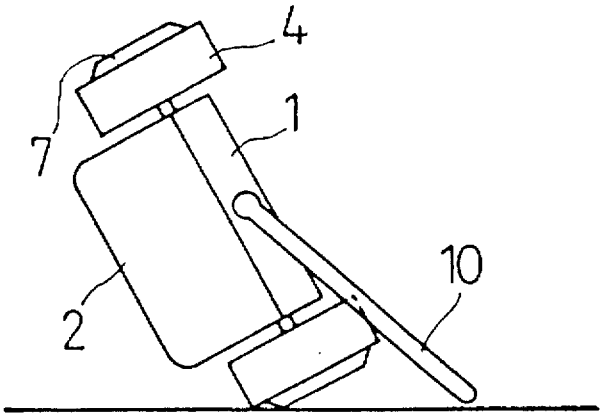
Figure 5D:
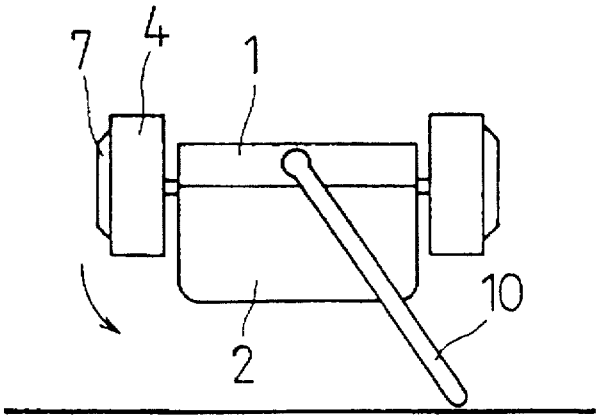
Figure 5E:
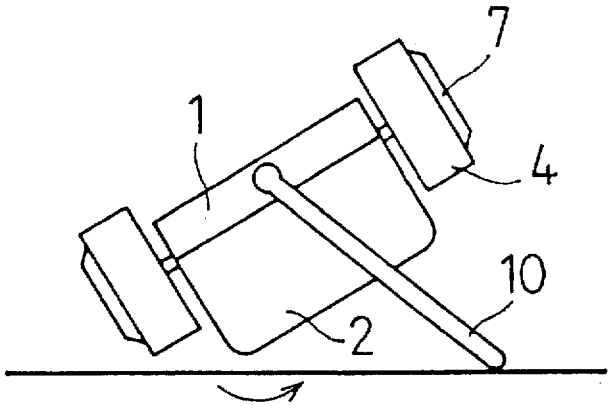
Figure 5F:
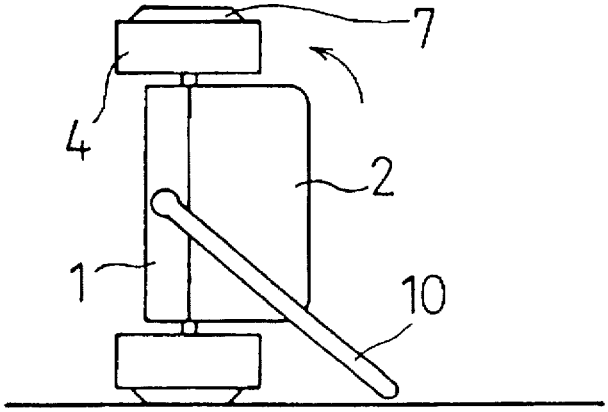

If the control IC 54 supplies the solenoid electromagnet control signal via the solenoid driving amplifier 59 to the solenoid electromagnet 41, then a current is supplied to the solenoid electromagnet 41 by which the fixed magnetic core is magnetized and the movable permanent magnet core 43 is attracted to the fixed magnetic core of the solenoid electromagnet 41. As a result, the bottom end of the rod 44 moves toward the flat gear 34 to push the same against the extension force of the spiral spring member 35 until the flat gear 34 moves into a position under the worm gear 15 so that the flat gear 34 is engaged with the worm gear 15 whereby the rotation of the worm gear 15 is transmitted through the flat gear 34 to the hexagonal shaft 33. As a result, the rotation arm 10 rotates in a clockwise direction. The free end of the rotation arm 10 actively hits and pushes down the road or ground so that the right side of the radio-controlled toy car is first lifted up powerfully, and subsequently the left side of the radio-controlled toy car is also lifted up whereby the radio-controlled toy car is tilted toward the left side, wherein the right half of the radio-controlled toy car is positioned above the left half thereof as illustrated in FIG. 5B. Since the rotation arm 10 further rotates in the clockwise direction, the radio-controlled toy car turns over and lies on its left side. The rotation arm 10 still further rotates in the clockwise direction so that the top of the body of the radio-controlled toy car faces downwardly as illustrated if FIG. 5C. Subsequently, the rotation arm 10 rotates further so that the left front and left rear tires 3 and 4 are lifted up and the radio-controlled toy car turns upside down, wherein the top of the body 2 is above the road or ground as illustrated in FIG. 5D. The rotation arm 10 rotates further so that the top of the body of the radio-controlled toy car faces down again as illustrated in FIG. 5E. The rotation arm 10 is still further rotated so that the radio-controlled toy car turns over and lies on its right side as illustrated in FIG. 5F. The rotation arm 10 then returns the car to the normal position at which the radio-controlled toy car travels as illustrated in FIG. 5A. As described above, the radio-controlled toy car shows quite novel and unique rolling motions which occur rapidly and unexpectedly during the normal travel of the radio-controlled toy car to attract a great deal of attention without, however, increasing the manufacturing cost or the difficulty for children to operate the toy car.

If the transmission of the solenoid electromagnet control signal via the solenoid driving amplifier 59 to the solenoid electromagnet 41 is discontinued, then the current application to the solenoid electromagnet 41 is discontinued. As a result, the movable permanent magnet core 43 moves out from the internal space of the fixed magnetic core in the solenoid electromagnet 41. Then, the bottom end of the rod 44 moves away from the flat gear 34 so that the flat gear 34 moves out from the position under the worm gear 15 by the extension force of the spiral spring member 35 is disengaged from the worm gear 15 whereby the transmission of the rotation of the worm gear 15 through the flat gear 34 to the hexagonal shaft 33 is discontinued. As a result, the driving power of the driving motor 11 is not transmitted to the hexagonal shaft 33 whereby the rotation arm 10 becomes positioned to extend upwardly and the radio-controlled toy car travels at the normal position.

A second embodiment according to the present invention will be described in detail with reference to the drawings. A radio-controlled toy car is provided, which has a rolling mechanism which is structurally different from that thereof in the first embodiment. The following descriptions will focus on structural differences of this embodiment from the first embodiment.

Figure 6:
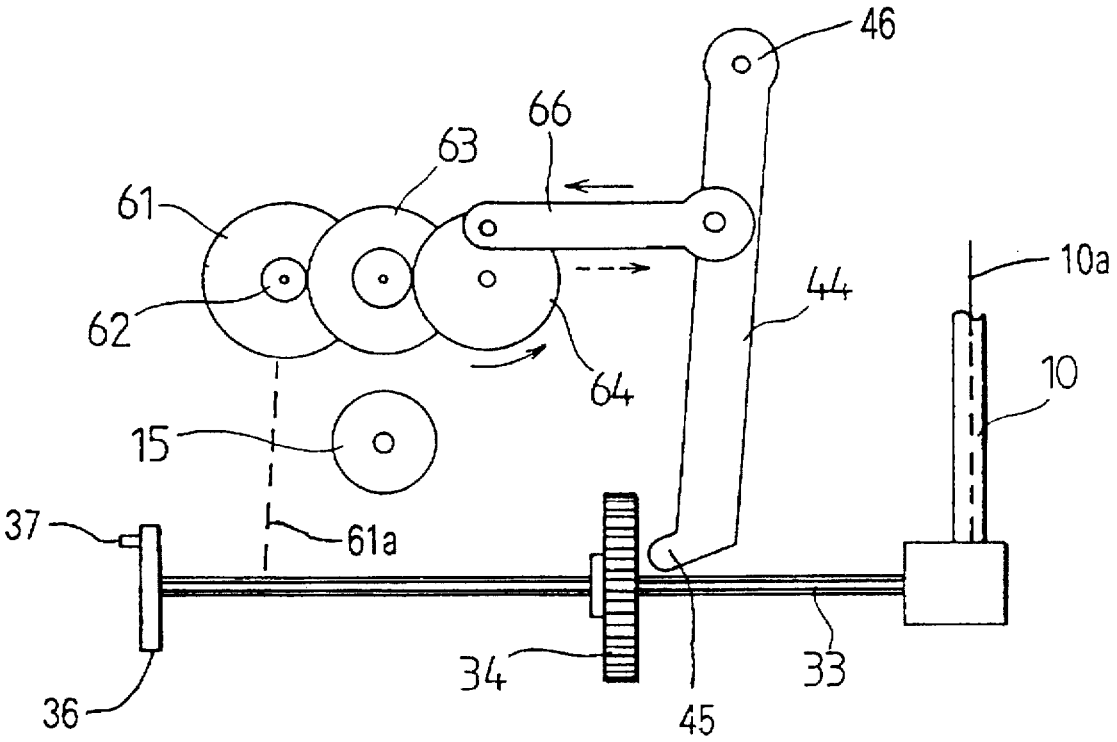
FIG. 6 is a view illustrative of a rolling mechanism having a rotation arm for rolling the radio-controlled toy car around a longitudinal axis thereof in accordance with the present invention.

The structural differences of this embodiment from the first embodiment are well illustrated in FIG. 6 of another rolling mechanism for causing the radio-controlled toy car to roll around a longitudinal axis thereof in accordance with the present invention. In this embodiment, in place of the solenoid electromagnet 41 illustrated in FIG. 2, an auxiliary motor and a gear transmission system as well as a crank are used.

With reference to FIG. 6, in the crank unit, an auxiliary motor 61 is provided. A first gear 62 is mechanically connected to a rotary shaft of the auxiliary motor 61. A second gear 63 is engaged with the first gear 62. The second gear 63 has a diameter much larger than that of the first gear 62. A third gear 64 is engaged with the second gear 63. The driving force of the auxiliary motor 61 is transmitted via the first and second gears 61 and 62 into the third gear 64. The third gear 64 is connected on its one side face at an eccentric position to a first end of a link rod 66 to constitute a crank mechanism. A second end of the link rod 66 is pivotally fixed to a rod 44 which has a top end 46 and a bottom end 45 which is in contact with the flat gear 34 but at an opposite side to the side at which the spiral spring member 35 (see FIG. 2) is provided. The rod 44 is allowed to rotate at a small angle around the top end 46 of the rod 44.

If the auxiliary motor 61 is driven, then the driving power of the auxiliary motor 61 is transmitted via the first and second gears 62 and 63 to the third gear 64 whereby the link rod 66 moves toward the auxiliary motor 61. As a result, the bottom end of the rod 44 also moves toward the flat gear 34 to push the same against the extension force of the spiral spring member 35 until the flat gear 34 moves into a position under the worm gear 15 so that the flat gear 34 is engaged with the worm gear 15 whereby the rotation of the worm gear 15 is transmitted through the flat gear 34 to the hexagonal shaft 33. As a result, if the auxiliary motor 61 is driven and the link rod 66 moves toward the auxiliary motor 61, then the driving power of the driving motor 11 is transmitted to the hexagonal shaft 33 whereby the rotation arm 10 rotates to have the radio-controlled toy car roll around the longitudinal direction in which the radio-controlled toy car travels. If the auxiliary motor 61 is driven again and the link rod 66 moves toward the rod 44, then the bottom end of the rod 44 moves away from the flat gear 34 so that the flat gear 34 moves out from the position under the worm gear 15 by the extension force of the spiral spring member 35 and is disengaged from the worm gear 15 whereby the transmission of the rotation of the worm gear 15 through the flat gear 34 to the hexagonal shaft 33 is discontinued. As a result, the driving power of the driving motor 11 is not transmitted to the hexagonal shaft 33 whereby the rotation arm 10 remains extended upwardly and the radio-controlled toy car travels normally.

Optionally, one or more piano wires 10A may be provided in rotation arm 10 to increase its strength.

The operation of the roll mechanism described above are the same as described with reference to FIGS. 5A through 5F in the first embodiment.

A third embodiment according to the present invention will be described in detail with reference to the drawings. The structural difference of this embodiment from the first embodiment is that an auxiliary motor is directly connected to a hexagonal shaft. For example, auxiliary motor 61 of the second embodiment may be directly connected to hexagonal shaft 33 as illustrated by the dashed line 61A in FIG. 6, instead of through the system of gears and rods shown.

In a fourth embodiment according to the present invention two separate driving motors are provided for respective left and right rear tires 4 whereby no special steering system is needed. This reduces the weight of the radio-controlled toy car. For example, a second driving motor 11 (not shown) may be connected to an axle for the right rear tire 4 in FIG. 3 that is separated from the left and center portion of the rotary shaft 12.

Whereas any further modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A mechanism for rolling a toy vehicle about the vehicle's longitudinal axis, the mechanism comprising:

a driving motor transmission for transmitting a motive force that propels the vehicle;

a rotation arm having a free end extending beyond a peripheral extent of the toy vehicle projected on a plane perpendicular to the vehicle's longitudinal axis, and a pivotable fixed end around which said rotation arm rotates;

a shaft connected to said fixed end for rotating said rotation arm;

a flat gear movable along said shaft and for rotating said shaft;

a worm gear connected to said driving motor transmission for selectively driving said flat gear;

a spring member for impelling said flat gear along said shaft away from said worm gear;

a pivotable rod for selectively impelling said flat gear along said shaft towards said worm gear; and means for moving said pivotable rod against a force from said spring member to selectively engage said flat gear with said worm gear, whereby the motive force from said driving motor transmission drives said rotation arm to roll the toy vehicle about the vehicle's longitudinal axis.

2. The mechanism of claim 1, wherein said means for moving comprises a solenoid electromagnet with a movable permanent magnet that moves responsive to application of a current to said solenoid electromagnet, said permanent magnet being connected to said pivotable rod to engage said flat gear with said worm gear upon application of the current to said solenoid electromagnet.

3. The mechanism of claim 1, wherein said means for moving comprises an auxiliary motor connected to a transmission gear system for translating a force from said auxiliary motor into motion of said pivotable rod.

4. The mechanism of claim 1, further comprising a disk member connected to said shaft and a spring connected to an eccentric position on said disk member for urging said shaft to a position at which said rotation arm is extended upwardly.

5. The mechanism as claimed in claim 1, wherein said rotation arm is made of a material resistive to friction and having a small friction coefficient.

6. The mechanism as claimed in claim 5, wherein said rotation arm is made of a material selected from the group consisting of polycarbonate and nylon.

7. The mechanism as claimed in claim 1, wherein said rotation arm includes piano wires to increase in strength thereof.

8. A mechanism for rolling a toy vehicle about the vehicle's longitudinal axis, the mechanism comprising:

a rotation arm having a free end extending beyond a peripheral extent of the toy vehicle projected on a plane perpendicular to the vehicle's longitudinal axis, and a pivotable fixed end around which said rotation arm rotates;

a shaft connected to said fixed end for rotating said rotation arm;

an auxiliary motor separate from means for propelling the vehicle, said auxiliary motor for generating a rotational force; and a rotational force transmission connecting said auxiliary motor to said shaft, whereby a force for rotating said rotation arm is independent of a force for propelling the vehicle.

9. A toy vehicle comprising:

a chassis having a longitudinal axis;

a body on said chassis;

a driving motor on said chassis for propelling the vehicle;

a driving motor transmission for transmitting a motive force from said driving motor to vehicle motive means;

a rotation arm having a free end extending beyond a peripheral extent of said body projected on a plane perpendicular to said chassis' longitudinal axis, and a pivotable fixed end around which said rotation arm rotates;

a shaft connected to said fixed end for rotating said rotation arm;

a flat gear movable along said shaft and for rotating said shaft;

a worm gear connected to said driving motor transmission for selectively driving said flat gear;

a spring member for impelling said flat gear along said shaft away from said worm gear;

a pivotable rod for selectively impelling said flat gear along said shaft towards said worm gear; and means for moving said pivotable rod against a force from said spring member to selectively engage said flat gear with said worm gear, whereby the motive force from said driving motor transmission drives said rotation arm to roll the toy vehicle about said chassis' longitudinal axis.

10. The vehicle of claim 9, wherein said means for moving comprises a solenoid electromagnet with a movable permanent magnet that moves responsive to application of a current to said solenoid electromagnet, said permanent magnet being connected to said pivotable rod to engage said flat gear with said worm gear upon application of the current to said solenoid electromagnet.

11. The vehicle of claim 9, wherein said means for moving comprises an auxiliary motor connected to a transmission gear system for translating a force from said auxiliary motor into motion of said pivotable rod.

12. The vehicle of claim 9, further comprising a disk member connected to said shaft and a spring connected to an eccentric position on said disk member for urging said shaft to a position at which said rotation arm is extended upwardly.

13. The vehicle as claimed in claim 9, wherein said rotation arm is made of a material resistive to friction and having a small friction coefficient.

14. The vehicle as claimed in claim 13, wherein said rotation arm is made of a material selected from the group consisting of polycarbonate and nylon.

15. The vehicle as claimed in claim 9, wherein said rotation arm includes piano wires to increase in strength thereof.

16. The vehicle as claimed in claim 9, wherein said body is provided with a plurality of convex portions which are made of a material resistive to friction but with a small friction coefficient to protect said body from damage due to friction when the vehicle turns upside down.

17. The vehicle as claimed in claim 16, wherein said convex portions are made of a material selected from the group consisting of metals, polycarbonate and nylon.

18. The vehicle as claimed in claim 9, wherein said vehicle motive means comprise tires with guard rings made of a material resistive to friction but with a small friction coefficient so that said guard rings extend outwardly to protect said tires from damage due to friction when said vehicle turns over and lies on its side.

19. The vehicle as claimed in claim 18, wherein said guard rings are made of a material selected from the group consisting of metals, polycarbonate and nylon.

20. A toy vehicle comprising:

a chassis having a longitudinal axis;

a body on said chassis;

a driving motor on said chassis for propelling the vehicle;

a driving motor transmission for transmitting a motive force from said driving motor to vehicle motive means;

a rotation arm having a free end extending beyond a peripheral extent of said body projected on a plane perpendicular to said chassis' longitudinal axis, and a pivotable fixed end around which said rotation arm rotates;

a shaft connected to said fixed end for rotating said rotation arm;

an auxiliary motor separate from said driving motor and said driving motor transmission, said auxiliary motor for generating a rotational force; and a rotational force transmission connecting said auxiliary motor to said shaft, whereby a force for rotating said rotation arm is independent of a force for propelling the vehicle.

* * * * *